US010127841B1

(12) United States Patent
Allred

(10) Patent No.: US 10,127,841 B1
(45) Date of Patent: Nov. 13, 2018

(54) CONFORMABLE COVER AND LABEL FOR THE END OF A TUBULAR OBJECT SUCH AS A ROLLED UP SET OF ARCHITECTURAL DOCUMENTS

(71) Applicant: Damon Allred, Culver City, CA (US)

(72) Inventor: Damon Allred, Culver City, CA (US)

( * ) Notice: Subject to any disclaimer, the term of this patent is extended or adjusted under 35 U.S.C. 154(b) by 0 days.

(21) Appl. No.: 15/896,422

(22) Filed: Feb. 14, 2018

Related U.S. Application Data

(63) Continuation of application No. 15/670,871, filed on Aug. 7, 2017, now Pat. No. 9,928,758.

(51) Int. Cl.
*G09F 3/02* (2006.01)

(52) U.S. Cl.
CPC ..... *G09F 3/02* (2013.01); *G09F 2003/0208* (2013.01); *G09F 2003/0251* (2013.01); *G09F 2003/0266* (2013.01)

(58) Field of Classification Search
CPC ... G09F 3/02; G09F 2003/0208; G09F 3/0295
See application file for complete search history.

(56) References Cited

U.S. PATENT DOCUMENTS 2,537,184 A * 1/1951 Dunn ..... B65D 3/10 206/226
3,718,999 A * 3/1973 Voyce ..... G09F 3/12 40/309
4,339,885 A * 7/1982 Brown ..... G09F 3/00 206/1.7
4,471,547 A * 9/1984 Koslow ..... G09F 3/00 242/613.5
4,876,809 A * 10/1989 Johnson ..... G09F 3/0295 40/309
5,010,667 A * 4/1991 Hassinger ..... G09F 3/00 40/309
6,385,879 B1 * 5/2002 Fisher ..... B65C 7/00 40/309
2004/0250951 A1 * 12/2004 Noworatzky ..... B65C 3/02 156/277
2007/0266493 A1 * 11/2007 Jimenez ..... A47K 13/24 4/661
2011/0289647 A1 * 12/2011 Chiao ..... B32B 7/12 2/69

* cited by examiner

*Primary Examiner* — Gary C Hoge

(57) ABSTRACT

A labeling apparatus for an end of a rolled set of drawings or any similarly shaped elongated object. A potential embodiment of the apparatus comprises a flexible sheet which can be drawn over an end of the elongated object. The flexible sheet comprises a surface which is capable of being written on with pen, pencil, marker or any writing instrument known in the art. The writable surface can be integral to the flexible sheet or can be a separate writable surface which can be coupled with the flexible sheet. The flexible sheet comprises an elastic gripping feature for coupling the sheet over the end of the elongated object. The writable surface can comprise coloring, patterning or other visual cues known to those in the art to assist a user in identifying the label.

14 Claims, 2 Drawing Sheets

CONFORMABLE COVER AND LABEL FOR THE END OF A TUBULAR OBJECT SUCH AS A ROLLED UP SET OF ARCHITECTURAL DOCUMENTS

The present application herein incorporates by reference in its entirety U.S. Non-Provisional application Ser. No. 15/670,871, file date Aug. 7, 2017.

BACKGROUND

This disclosure is directed toward an identification labeling apparatus for labeling an end of a rolled up set of drawings or similarly shaped object.

Many architectural, engineering drawings (and the like) are printed on large sheets of paper. Drawings can be rolled up and a rubber band placed around the roll to prevent unrolling. Architectural firms typically have many rolled up drawing sets at any one time. There are many ways to store the rolls. Rolls can be placed into individual cubby holes either vertical or horizontal. Rolls can also be stored on horizontal shelving units, piled upon one another. Locating a specific drawing can be time consuming as without any labeling apparatus, the rolls have to be unrolled to view the title block.

Many labeling apparatuses have been proposed in the past for labeling rolled up drawings to allow identification without handling of the roll. U.S. Pat. No. 5,010,667 (the '667 patent) shows a piece of heavy stock paper which is bent and inserted into the center hole of a drawing set. This system is capable of identifying a rolled drawing from the end; however, it is not uncommon for the tag to fall out of the hole. Additionally, the labeling tag is a fixed size which is typically smaller than the available area of the end of the roll. This limitation prevents a user from exploiting the full end area for more clearly identifying the content of the roll.

U.S. Pat. No. 6,385,879 to Fisher (the '879 patent) is a multipronged apparatus which is inserted into the hole at the end of a roll. The apparatus is extremely expensive relative to other solutions in the market. The tines of the apparatus can damage the drawing sheets at the area of contact of the apparatus and the drawing. It is a one or two size(s) fits all drawing holes, which typically makes the fit too tight or loose. The tines themselves "take a set" when inserted into the drawing for a length of time, making it less adaptable for future uses.

U.S. Pat. No. 4,471,547 to Koslow (the '547 patent) discloses an apparatus which exploits the hole in a rolled drawing. The apparatus is extremely expensive to manufacture as well as difficult to use. The inner most layers of the drawing need to be bent, creating a layer which cuts across the center hole. This layer is difficult to create and hold onto as the apparatus is inserted on the top and bottom of this layer. The size of the labeling surface is significantly smaller than the available cross sectional area of the roll. This results in a much smaller label which is less discernible to the eye.

SUMMARY

The identification labeling apparatus instant disclosure presents potential embodiments which overcome the deficiencies of the prior art as discussed above. This disclosure also presents products which are less expensive and more effective at identifying the roll by utilizing the available area of the end of the roll. This disclosure also presents marking schemes which enhance identifiability of the roll.

DETAILED DESCRIPTION

The instant disclosure is directed to a low cost, re-usable, lightweight, customizable identification labeling apparatus. Several details describing the structures that are well-known and often associated with labeling systems are not set forth in the following description to avoid unnecessarily obscuring the description of the various embodiments of the disclosure. Moreover, although the following disclosure sets forth several embodiments, several other embodiments can have different configurations or different components than those described in this section. In particular, other embodiments may have additional elements or may lack one or more of the elements described below with reference to the Figures. Many of the elements included in the following Figures are not drawn to scale for purposes of clarity and/or illustration.

The present disclosure solves many of the above mentioned problems with the prior art and provides a distinct advance in the art of identification labeling for rolled drawings and similarly shaped objects. An embodiment of the present disclosure can comprise a cover for an end of a rolled drawing. Potential embodiments of end covers can include small covers for very small rolled drawings as well as large covers for large sets of drawings. The adaptability of a cover to fit a variety of drawing sizes can create end covers which can be tight or loose fitting as well as any fit in between tight and loose. An end cover can comprise a surface which is capable of being written on or accepting preprinted adhesive labels. The writable surface can encompass the entire surface of the end cover including the portion that is wrapped around the roll and is in contact with the sides of the roll. An end cover can extend down the length of the roll as much as a foot, providing additional writing area. An end cover can also be manufactured with a variety of colors and patterns to make the identification easier to the eye.

Figure 1:
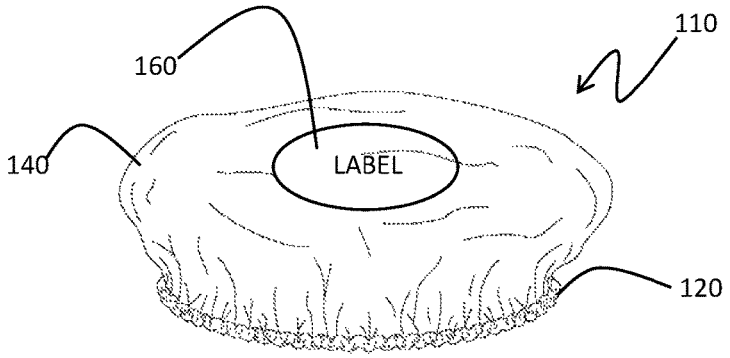
FIG. 1 is a perspective view of an identification label

FIG. 1 is a side view illustration of a potential embodiment of an end cover (110). End cover (110) comprises a securing band (120) which is capable of providing a squeezing force on the object over which end cover (110) is drawn. In FIG. 1, the securing band runs the entire perimeter of the end cover (110). Other embodiments exist in which the securing band does not extend around the complete perimeter but exists in sections. For example a securing band may comprise two portions of the perimeter of end cover (110). Each of the two portions may be twenty percent of the perimeter in length and be located opposite one another. Using a clock analogy, one portion may be centered at twelve o'clock and the other portion may be centered at 6 o'clock. A securing band can be manufactured from any elastic material known in the art including rubber bands.

End cover (110) also comprises cover material (140). Cover material (140) is presented in FIG. 1 as a complete and continuous cover material. Other embodiments exist in which cover material is not complete and continuous. Cover material may include any number of cutouts, holes or voids as a user may wish. A cutout design can provide additional discernibility of the label. Cover material (140) can be manufactured from fabric, plastic, rubber or any other material known to those in the art. Cover material can loosely fit an end of a roll, tightly fit the end of the roll or provide any fit in between loose and tight. Cover material (140) can be manufactured from clear material or from material of any color including fluorescent coloring.

Cover material (140) can also comprise indicia. The indicia can be comprised of any pattern. Patterning can be geometric or contain images or any other design which can provide additional discernibility. Cover material (140) can comprise an outer surface which at least a portion of which can be written on with pen, pencil, marker or any other writing instrument known to those in the art. Cover material (140) can be manufactured from material capable of coupling with adhesive label (160). A separate label (160) can be coupled with cover material (140). Label (160) is presented in FIG. 1 as generally circular. Label (160) can be any shape. Label (160) can be shaped like a house to indicate drawings of a house. Similarly label (160) can be shaped like a bridge for drawings of a bridge. This disclosure does not limit the shapes label (160) can take. Label (160) can have patterns, drawings, logos, trademarks or any other design imprinted on label (160) to enhance discernibility. Label (160) can be printed in any printer, including a standard laser printer. Preprinted label (160) can be fabricated from a sheet of adhesive backed paper. The diameter of the roll to be labeled can be measured and a label of the same size printed on adhesive backed paper, maximizing the size of the label and increasing the labels discernibility.

Figure 2:
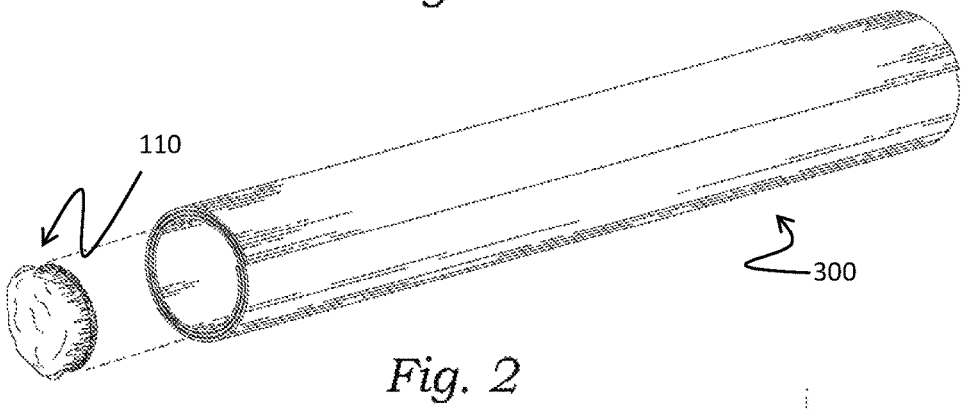
FIG. 2 is a perspective view of an identification label prior to application around an end of a rolled up drawing set.

FIG. 2 presents an end cover (110) prior to installation around an end of rolled document (300). The potential embodiment presented in FIG. 2 can comprise all of the variations described above. Additionally, and end cover (110) can also be installed on each of the ends of the rolled document for those situations in which both ends of the document can be accessed or viewed.

Figure 3:
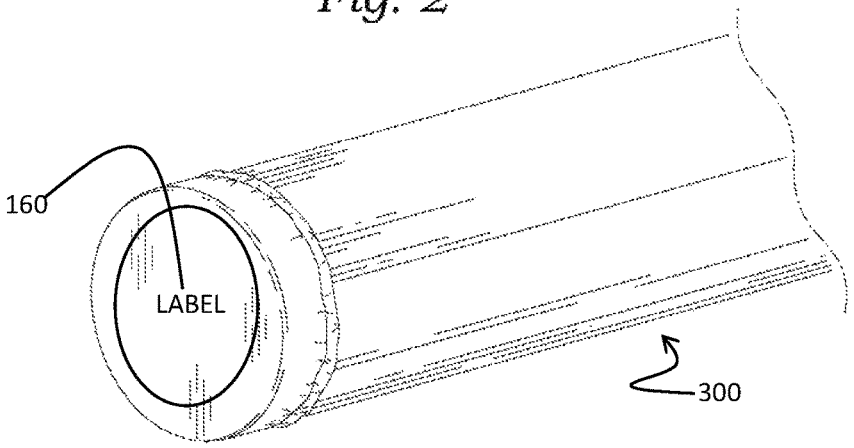
FIG. 3 is a detailed view of an identification label secured around a rolled up drawing set.

FIG. 3 presents a close up view of end cover (110) installed on one end of rolled document (300). This view presents a snug fitting end cover, which extends down the document a relatively short distance. As described above, an end cover can be significantly larger and be pulled down the document significantly further than presented in FIG. 3.

Figure 4:
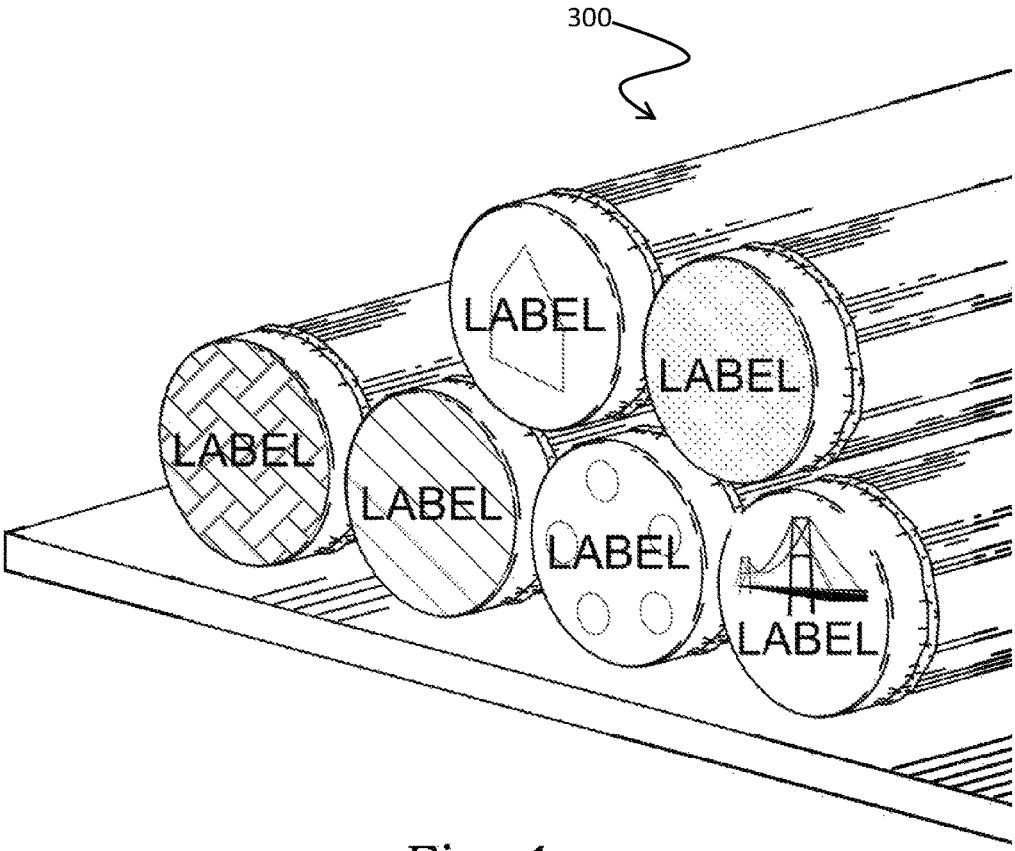
FIG. 4 presents several drawings with end covers stored on a horizontal shelf. The end covers have a variety of sample designs.

FIG. 4 presents several rolled up drawings with end covers (110) installed on the ends of each of the documents. Several different patterns are presented on the ends of the drawings showing the impact on discernibility. A user can select any pattern, logo, image or similar which will remind the user which drawing is which. The pattern, logo, image or similar can be printed on cover material (140) or the pattern, logo, image or similar can be printed on a separate writable surface (160) and coupled with cover material (140).

From the foregoing, it will be appreciated that specific embodiments have been described herein for purposes of illustration, but that the invention may include other embodiments as well. Certain aspects of the disclosure described in the context of particular embodiments may be combined or eliminated in other embodiments. Further, while advantages associated with certain embodiments have been described in the context of those embodiments, other embodiments may also exhibit such advantages, and not all embodiments need necessarily exhibit such advantages to fall within the scope of the disclosure. Accordingly, the invention can include other embodiments not explicitly shown or described above. Therefore, the invention is not limited, except as by the appended claims.

I claim:

1. An apparatus for labeling rolled documents comprising:
a cover material which can be drawn over an end of said rolled document; and
a securing band coupled with the cover material; and
the securing band couples the cover material with the rolled document; and
the cover material is capable of being written on; and
wherein the cover material is coupled with an end of the rolled document.

2. The labeling apparatus of claim 1 in which the cover material is manufactured from plastic.

3. The labeling apparatus of claim 1 in which the securing band is manufactured from rubber.

4. The labeling apparatus of claim 1 in which the cover material is printed with identification enhancing indicia.

5. The labeling apparatus of claim 1 in which the cover material is printed with a logo which enhances identifiability.

6. The labeling apparatus of claim 1 in which the cover material is printed with an image which enhances identifiability.

7. The labeling apparatus of claim 1 in which the cover material is printed with a color which enhances identifiability.

8. The labeling apparatus of claim 1 further comprising a label which is coupled with the cover material.

9. The labeling apparatus of claim 8 in which the writable surface is generally the same diameter as the rolled document.

10. The labeling apparatus of claim 8 in which the cover material is printed with identification enhancing indicia.

11. The labeling apparatus of claim 8 in which the writable surface is printed with a pattern enhances identifiability.

12. The labeling apparatus of claim 8 in which the cover material is printed with a logo which enhances identifiability.

13. The labeling apparatus of claim 8 in which the cover material is printed with an image which enhances identifiability.

14. The labeling apparatus of claim 8 in which the cover material is printed with a color which enhances identifiability.

* * * * *